US007334763B1

(12) United States Patent
Rice

(10) Patent No.: US 7,334,763 B1
(45) Date of Patent: Feb. 26, 2008

(54) SOCKET HOOK BRACKET ASSEMBLY

(75) Inventor: Jeremy T. Rice, Onalaska, WI (US)

(73) Assignee: Jeremy T Rice, Onalaska, WI (US)

( * ) Notice: Subject to any disclaimer, the term of this patent is extended or adjusted under 35 U.S.C. 154(b) by 175 days.

(21) Appl. No.: 11/362,577

(22) Filed: Feb. 27, 2006

(51) Int. Cl.

| | |
|---|---|
| ***A47K 1/00*** | (2006.01) |
| ***A47K 5/00*** | (2006.01) |
| ***A47B 96/00*** | (2006.01) |
| ***E04G 5/06*** | (2006.01) |
| ***F16L 3/08*** | (2006.01) |

(52) U.S. Cl. ..... 248/224.7; 248/220.31; 248/220.41; 248/224.8; 211/57.1; 211/60.1

(58) Field of Classification Search ..... 248/220.22, 248/220.31, 220.41, 220.1, 222.2, 220.4, 248/224.3, 224.7, 224.8; 211/57.1, 59.1, 211/60.1; 40/642.01

See application file for complete search history.

(56) References Cited

U.S. PATENT DOCUMENTS

| | | | | |
|---|---|---|---|---|
| 3,452,954 | A | 7/1969 | Lucietto et al. | |
| 4,319,730 | A | 3/1982 | Thalenfeld | |
| 4,452,360 | A | 6/1984 | Barnes | |
| 4,502,602 | A | 3/1985 | Swanson | |
| 4,688,683 | A | 8/1987 | Thalenfeld et al. | |
| 4,809,940 | A | 3/1989 | Trestyn | |
| 5,144,345 | A | 9/1992 | Nyman | |
| 5,234,344 | A | 8/1993 | Baron | |
| 5,423,436 | A | 6/1995 | Morrow | |
| 5,521,911 | A | 5/1996 | Nyman | |
| 5,531,415 | A | 7/1996 | Kallemeyn | |
| 5,531,417 | A | 7/1996 | Valiulis et al. | |
| 5,632,387 | A * | 5/1997 | Johnson | 211/59.1 |
| 5,645,256 | A * | 7/1997 | Thomas, II | 248/222.11 |
| 5,901,860 | A | 5/1999 | Nowicki | |
| 6,059,124 | A * | 5/2000 | Weck et al. | 211/57.1 |
| 6,193,079 | B1 * | 2/2001 | Wiemer | 211/59.1 |
| 6,234,436 | B1 | 5/2001 | Kump | |
| 6,405,984 | B1 | 6/2002 | Simons et al. | |
| 6,769,656 | B1 | 8/2004 | Botkin et al. | |

* cited by examiner

*Primary Examiner*—Amy J. Sterling

(57) ABSTRACT

A displaying fixture assembly for mounting on an upright support surface and for supporting a plurality of merchandise items comprises a planar base member adapted for reversible attachment to the upright support surface. The base member includes an aperture opposite the upright support surface. An elongated bar member has first and second ends and a central portion. The bar member's first end is insertable into the base member's aperture for releasably securing the bar member to the base member. The bar member's second end is angled relative to the central portion thereof. A handle member has a cylindrical body portion with an aperture at a first end thereof. The aperture is sized to releasably secure the bar member's angled second end therein. The handle member includes an enlarged flange section, adjacent the apertured first end thereof. By inserting the bar member's angled second end into the handle member's apertured first end, a user can remove the bar member's first end from the base member and add additional merchandise items to the bar member adjacent the first end thereof.

18 Claims, 5 Drawing Sheets

SOCKET HOOK BRACKET ASSEMBLY

CROSS-REFERENCE TO RELATED APPLICATIONS, IF ANY

Not applicable.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a bracket assembly for displaying retail items and, more particularly, to a bracket assembly that allows newer merchandise to be positioned behind older merchandise and, most particularly, to a bracket assembly that prevents merchandise from slipping off the bracket when restocking the bracket with newer merchandise.

2. Background Information

Retail establishments frequently employ linear, cylindrical brackets extending in a horizontal orientation from a vertical surface for displaying merchandise for consumers. The merchandise may include a hook or tab with an aperture that slips over the end of the cylindrical bracket such that a number of merchandise items hang vertically from a single bracket. The vertical surface often contains a number of locations from which the brackets can extend. Thus, the brackets can be arranged on the vertical surface to accommodate merchandise items of varied dimensions. Often, a pair of brackets is employed in close proximity to each other. A first bracket holds the merchandise items and the second bracket, located directly above the first bracket, includes a small sign at the end opposite the vertical surface, the sign indicating the price of the merchandise item. The consumers need only grasp one or more merchandise items and pull the attached tab off of the end of the linear, cylindrical bracket for purchase.

It is common practice for merchants to "rotate their stock," such that older items are closer to the end of the first bracket opposite the vertical surface, so that the older items are sold before newer items. This is particularly important where the merchandise item is perishable, such as a food item with limited shelf life. The brackets that are presently available attach to the vertical surface by mechanisms that result in the attachment end of the bracket being greatly enlarged. Thus, older merchandise items must be removed from the bracket end opposite the vertical surface, newer merchandise items place on the bracket, and then the older items replaced on the bracket. This involves much time and trouble when restocking such brackets. Some examples of bracket inventions for which patents have been granted include the following.

Lucietto et al., in U.S. Pat. No. 3,452,954, describe a bracket for attachment to an apertured panel. The bracket includes a main body portion defining a vertical opening for receiving the bent-over end of an article supporting rod. A channel at the top of the bracket receives the shank of the rod. The channel is defined in part by opposed arms which are spread apart as the shank is forced into the channel, wherein the rod will be firmly held. The bracket may include a locking member carried by passages formed in the body portion of the bracket. The locking member is reciprocally movable between a locked position and an unlocked position. In the locked position, it bears against the apertured panel to firmly maintain the bracket in place.

In U.S. Pat. No. 4,319,730, Thalenfeld discloses a self-locking merchandise hook for mounting on perforated panel board, preventing accidental dislodgement of the hook from its mounted position. The merchandise hook is a single piece molding of all plastic material, including integral plastic hook and base portions, as well as integral mounting lugs. In other forms, the hook may comprise more than one part. In all forms, a self-locking feature is provided in the form of an upwardly extending, flexible resilient tongue, which overlies the front face of a perforated panel board, on which the merchandise hook is mounted. In order to mount or dismount the merchandise hook, the locking tongue must be resiliently deflected by the application of at least modest external force. Although intentional mounting and dismounting require no additional action or manipulation, unintentional dislodgement is virtually eliminated.

Barnes, in U.S. Pat. No. 4,452,360, describes a hanger assembly that includes a U-shaped hanger and a separate bracket for mounting the hanger on a perforated panel. The bracket is formed so as to enable the hanger to be quickly and easily attached to and detached from the bracket. It is possible to add merchandise to the rear of other hanging merchandise by slipping the new merchandise over the opposite end of the U-shaped hanger and moving it to the opposite end thereof.

In U.S. Pat. No. 4,502,602, Swanson discloses a display fixture with a removable arm, which allows the user to quickly and easily replenish the fixture with display items in such a manner that the newly loaded display items are positioned at the rear of the display fixture. The display fixture preferably includes a U-shaped base which is attached to an upright display support structure using any convenient means. The display fixture is also provided with an arm structure compatible with the desired display merchandise, with the arm being removable from the display fixture such that display merchandise can be replenished by loading the rear connection end of the arm. The U-shaped base is apertured, removably receiving the rear end of the arm structure, in a cantilever fashion.

Thalenfeld et al., in U.S. Pat. No. 4,688,683, describe a merchandise display hook assembly that provides high density display of carded merchandise and the like on apertured panel board display structures. The device includes a base member engageable with and supported by the apertured panel, and an adapter member which is slidably mounted on the base member for limited lateral sliding movement over a distance approximating a substantial portion of the center-to-center distance between apertures in the panel board. A merchandise display hook element is removably seated on the adapter member to carry the merchandise. The laterally adjustable adapter member enables the hook to be adjusted laterally within the mounting area for the assembly as necessary to achieve high density utilization of the display area and without interference between adjacently displayed merchandise to avoid unnecessarily wide spacing between adjacent articles.

In U.S. Pat. No. 4,809,940, Trestyn discloses a bracket adapted to be secured to a perforated wall. The bracket includes a first member extending generally in a first direction, a second pivotal member disposed on the first member and having an L-shaped section having two legs. The pivotal member has two positions; in a first position, the first of the two legs arranged farthest from the pivotal member are disposed generally horizontally for insertion into a perforation of the wall; and in a second position, the first of the two legs are disposed generally vertically after the first leg has been inserted into a perforation in the wall, for securing the first member to the wall by the influence of gravity, whereby the first member extends outwardly from the wall in the first direction.

Nyman, in U.S. Pat. No. 5,144,345, describes a pair of non-prescription eyeglasses mounted on a cantilevered support by a hanger that includes an element constructed of relatively stiff, resilient plastic material. Such elements include a relatively wide main section, having an aperture which receives the support arm and a relatively narrow extension. The latter pass through the nose gap of the eyeglasses and is reversely bent to form a loop that surrounds the eyeglass frame bridge. In a first embodiment of this invention a rivet maintains the loop closed and prevents casual removal of the hanger from the eyeglasses. In a second embodiment a snap-type device holds the loop closed. This snap-type closure cannot be opened casually, at least for the first opening thereof.

In U.S. Pat. No. 5,236,344, Baron describes a panel fixture adapted to be inserted into a cavity formed in a panel, the panel fixture releasably receiving an accessory. The panel fixture can be mounted within a routed cavity in a panel or wall such that its faceplate can be substantially flush with the panel surface or wall surface to provide a convenient, randomly selected location for supporting an accessory, such as a hook bracket or a shelf support bracket. The mounting of the panel fixture into the cavity simultaneously holds the panel against a wall structure. The faceplate has a slot located in an upper portion of the fixture. An accessory bracket to be inserted in the fixture may have a stepped upper plate part and a planar lower plate part and is mountable in/on the fixture, with the stepped upper plate part of the accessory bracket inserted and confined in the slot of the fixture faceplate, and with the planar plate part of the accessory bracket fitting flat against the recessed planar surface of the body of the fixture. A separate cover closure plate is provided, whereby when an accessory is not received in the panel fixture, the cover closure plate is fitted into the panel fixture.

Morrow, in U.S. Pat. No. 5,423,436 describes a product display system to inhibit theft and shoplifting. A product package has an orifice formed therein with a tab extending down through the center top portion of the orifice. The orifice has a lower portion connecting to two side portions. The side portions are configured to extend over a product support member. The product support member has a pair of rods extending substantially parallel with a connecting member at an extended end. The connecting portion of the orifice fits over the connecting member and can pass beyond the connecting member so that the tab extends downward between the rods. Therefore, the package cannot be pulled directly off the end of the support member as the tab engages the cross member. The support member also includes an apparatus for preventing the support member from being pulled from pegboard or other mounting surfaces. The support member includes a second member to prevent the support member from being pivoted to be removed.

In U.S. Pat. No. 5,521,911, Nyman discloses an eyeglass display system that utilizes a combination of an eyeglass display member and an eyeglass contacting member. The eyeglass contacting member has an encircling portion adapted to encircle at least a part of the frame of the eyeglasses, and does not interfere with a potential user's view through the lenses when the eyeglasses are tried on. A cantilever support extending from the eyeglass display member supports a plurality of eyeglass contacting members and associated eyeglasses.

Kallemeyn, in U.S. Pat. No. 5,531,415, describes a tool holder for use in a wall panel that includes a circularly cylindrical anchor bar, having a length greater than the width of a slot of the panel and not greater than the minimum length of the slot. A circularly cylindrical connector bar has the anchor bar extending beyond opposite sides of the connector bar. A base is rigidly connected to the other end of the connector bar and extends on opposite sides thereof and spaced from the anchor bar by a spacing S not less than the panel thickness. The base extends in at least two intersecting directions on opposite sides of the connector at the spacing S from the anchor bar for contacting the panel at locations spaced about the connector bar and stabilizing the holder against tipping in any direction relative to the wall panel when the connector bar protrudes the slot with the anchor bar extending on opposite sides of the slot. The base includes opposite leg portions of a U-shaped arm that are rigidly connected from medial locations thereon to opposite sides of the connector bar. The leg portions are coplanar at the spacing S from the anchor bar, a portion of the arm projecting from the base for supporting an article thereon. The arm, the base, the anchor bar and the connector bar are formed of a wire material having a single uniform circular cross-sectional diameter that is not greater than the width of the slot.

In U.S. Pat. No. 5,531,417, Valiulis et al. disclose a wire loop hook for displaying merchandise that includes a rounded nose which supports a label holder in a downwardly and forwardly inclined position. The top surface of the holder faces upwardly and forwardly and serves as a mounting surface for a merchandise identification label. In one embodiment, the nose of the loop hook itself is inclined downwardly and forwardly to enable use of a label holder of extremely simple construction. In another version, the loop hook is of conventional design with a generally horizontally extending nose, while the label holder includes angled mounting and label holding portions to enable the holder to be attached to the generally horizontal nose with the label holding portion inclined downwardly and forwardly from the nose.

Nowicki, in U.S. Pat. No. 5,901,860, describes a stocking rod for assisting in the stocking of peggable packages onto support pegs for display and sale, the rod holding a number of packages. The rod has a tip portion that can be stabilized against the support peg. When the tip portion of the rod is stabilized, the packages can be slid from the rod onto the peg for display. The rod can be straight or provided with an angled tip portion so that it can easily be aligned with a variety of peg configurations.

In U.S. Pat. No. 6,234,436, Kump discloses a heavy duty display hook, which supports point of purchase items or packages, and is insertable into a rectangular aperture of a panel, such as a cardboard panel provided with a number of spaced apertures for display hooks. The display hook includes a front plate which is substantially vertically disposed in use and which has an upper end and a lower end and an elongated support member which projects forwardly from and extends upwardly in slightly inclined fashion to the front plate. A pair of arms extends rearwardly from the front plate. A slot is disposed between the pair of arms. The arms have a first section, which extends through the slot in the panel.

A second section of the arms extends upwardly from the first section. The second sections are spaced from and are generally parallel to the front plate. A wing may extend away from each of the second sections.

Simons et al., in U.S. Pat. No. 6,405,984, describe a peg retaining device for preventing the pegs from falling out of the holes in the pegboard. The peg retaining device includes a retainer having a generally planar back side and also having a top, a bottom, and a front side. The device is adapted to mount over a portion of at least one peg on a pegboard for securely retaining the at least one peg to the pegboard. The device includes fastening members being disposed through the retainer and being adapted to securely and removably engage in holes of the pegboard.

In U.S. Pat. No. 6,769,656, Botkin et al. disclose an assembly for supporting a cantilevered bracket and an assembly for supporting an object. The assemblies include a mounting structure, having a first surface and an opposite surface and defining an opening there between. A relief is defined at a distance from the first surface and surrounding a portion of the opening. An engagement member has a body that is engageable within the opening, a retaining flange projecting from the first end of the body and shaped to be received within the relief, and a retaining member disposed on the opposite end and having a bearing surface. A cantilevered support member projects from the retaining member.

Applicant has devised a bracket system that overcomes the problem of restocking a bracket with newer merchandise items so that older merchandise items are closer to the end of the bracket opposite the vertical surface, whereby the older merchandise items are sold before the newer merchandise items.

SUMMARY OF THE INVENTION

The invention is directed to a displaying fixture assembly adapted for mounting on an upright support surface and supporting a plurality of merchandise items thereon. The fixture assembly comprises a planar, base member adapted for reversible attachment to the upright support surface. The base member includes an aperture opposite the upright support surface. An elongated bar member has first and second ends and a central portion. The bar member's first end is insertable into the base member's aperture for releasably securing the bar member to the base member. The bar member's second end is angled relative to the central portion thereof. A handle member has a cylindrical body portion with an aperture at a first end thereof. The aperture is sized to releasably secure the bar member's angled second end therein. The handle member includes an enlarged flange section adjacent the apertured first end thereof. By inserting the bar member's angled second end into the handle member's apertured first end, a user can remove the bar member's first end from the base member and add additional merchandise items to the bar member adjacent the first end thereof.

In a further embodiment of the invention, the base member of the display fixture assembly includes a second aperture opposite the upright support surface. A second elongated bar member has first and second ends and a central portion. The second bar member's first end is insertable into the base member's second aperture for releasably securing the second bar member to the base member. The second bar member's second end also is angled relative to the central portion thereof. The second bar member's second end is also fitted with an information display device.

DESCRIPTION OF THE EMBODIMENTS

Nomenclature

10 Fixture Assembly
20 Base Member
22 First Aperture
24 Second Aperture
26 Thicker Section of Base Member
28 Attachment Hooks of Base Member
30 First Elongated Bar Member
32 First End of First Bar Member
34 Second End of First Bar Member
36 Central Portion of First Bar Member
38 Detent Device of First Bar Member
40 Second Elongated Bar Member
42 First End of Second Bar Member
44 Second End of Second Bar Member
46 Central Portion of Second Bar Member
48 Detent Device of Second Bar Member
50 Handle Member
52 Cylindrical Body of Handle Member
54 First End of Cylindrical Body
56 Aperture in First End of Cylindrical Body
58 Flange Section of Handle Member
60 Information Holder Device
A Apertures in Upright Support Surface
B Upright Support Surface
M Merchandise Item Construction The invention is a displaying fixture assembly adapted for mounting on an upright support surface and supporting a plurality of merchandise items thereon. The displaying fixture assembly comprises a planar base member adapted for reversible attachment to the upright support surface. The base member includes an aperture opposite the upright support surface. An elongated bar member has first and second ends and a central portion. The bar member's first end is insertable into the base member's aperture for releasably securing the bar member to the base member. The bar member's second end is angled relative to the central portion thereof. A handle member has a cylindrical body portion with an aperture at a first end thereof. The aperture is sized to releasably secure the bar member's angled second end therein. The handle member includes an enlarged flange section adjacent the apertured first end thereof. By inserting the bar member's angled second end into the handle member's apertured first end, a user can remove the bar member's first end from the base member and add additional merchandise items to the bar member adjacent the first end thereof.

In a further embodiment of the invention, the base member of the display fixture assembly includes a second aperture opposite the upright support surface. A second elongated bar member has first and second ends and a central portion. The second bar member's first end is insertable into the base member's second aperture for releasably securing the second bar member to the base member. The second bar member's second end also is angled relative to the central portion thereof. The second bar member's second end is also fitted with an information display device.

Figure 1:
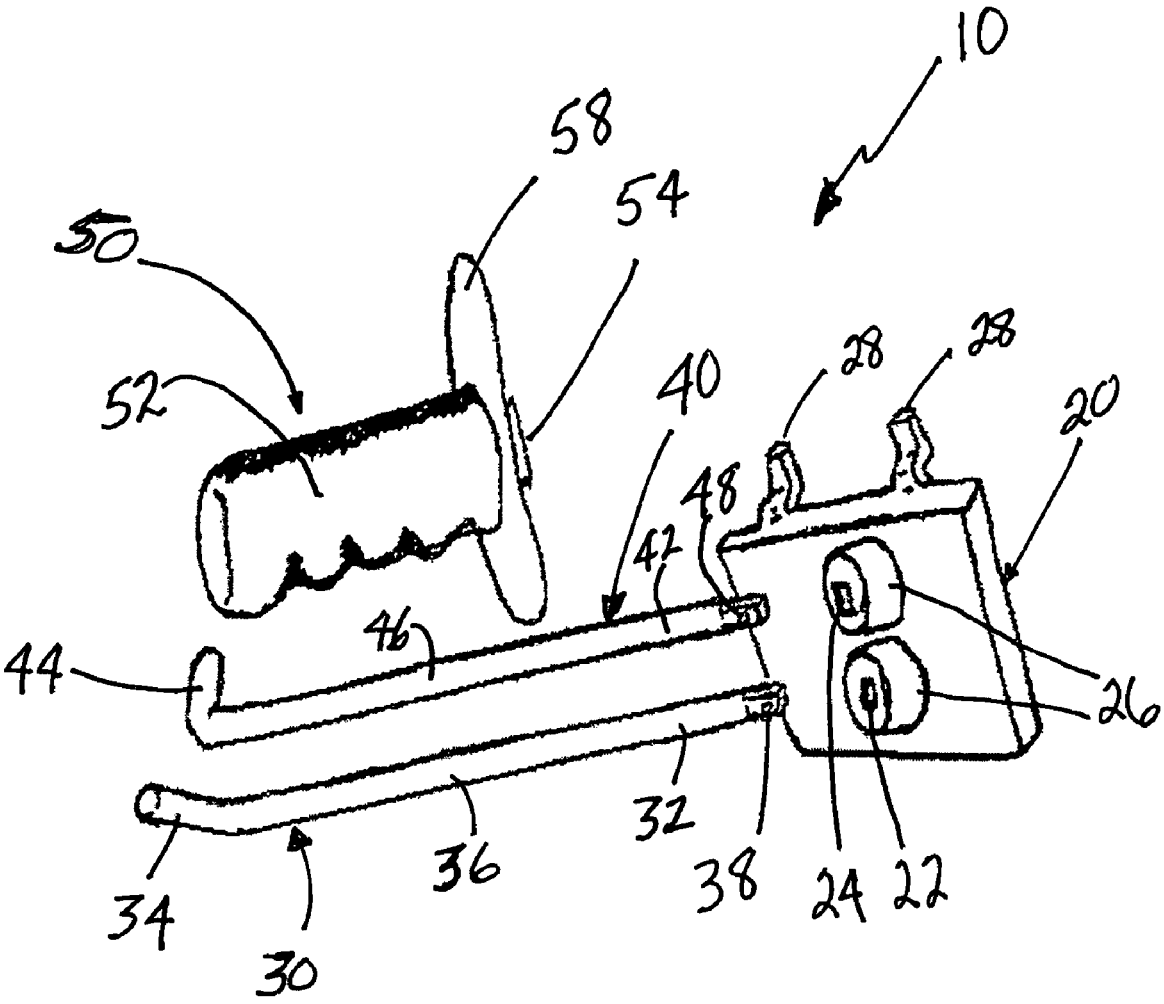
FIG. 1 is a perspective view of one embodiment of the displaying fixture assembly of the present invention.
Figure 2:
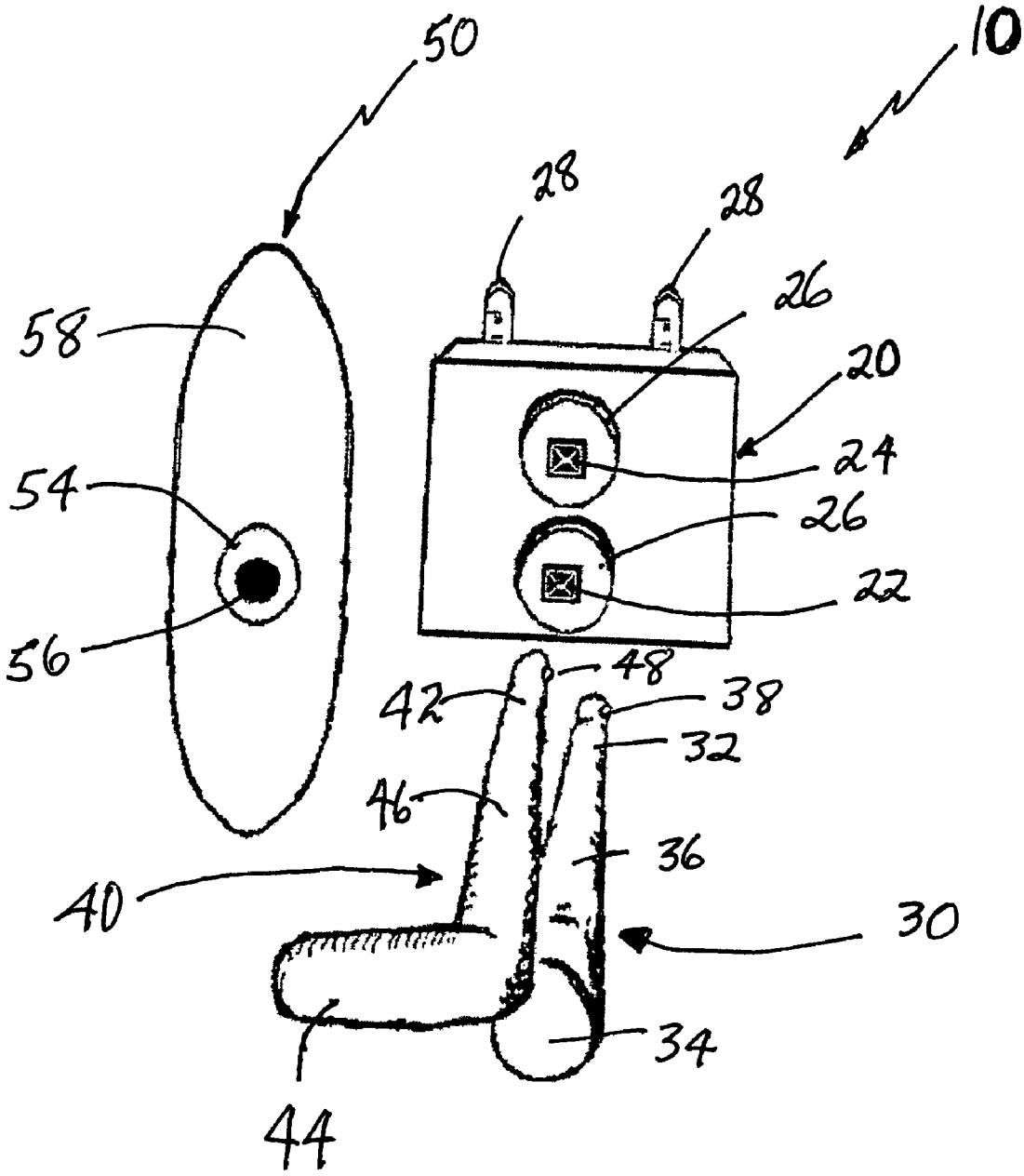
FIG. 2 is another perspective view of one embodiment of the displaying fixture assembly of the present invention.
Figure 3:
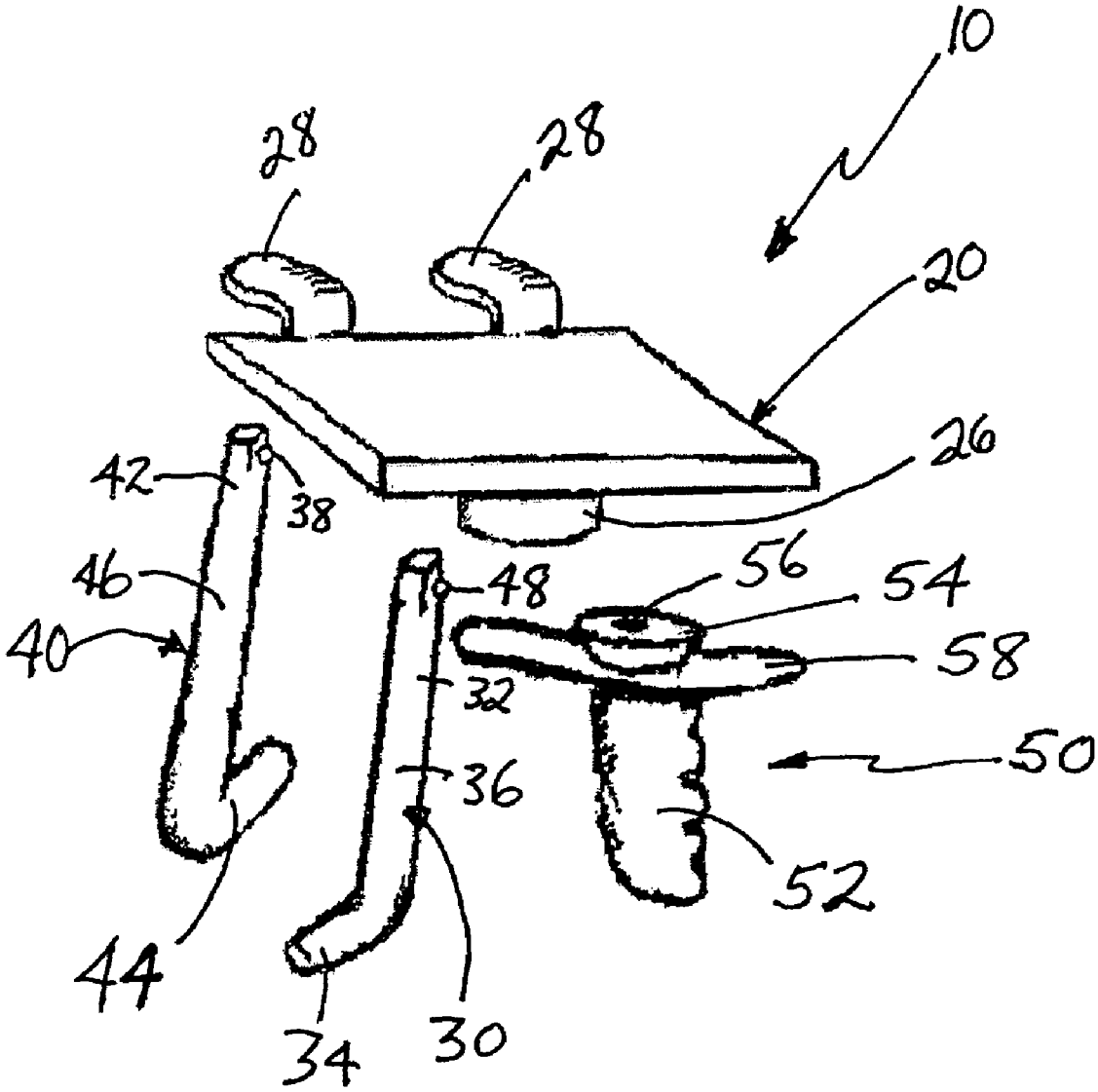
FIG. 3 is another perspective view of one embodiment of the displaying fixture assembly of the present invention.
Figure 4:
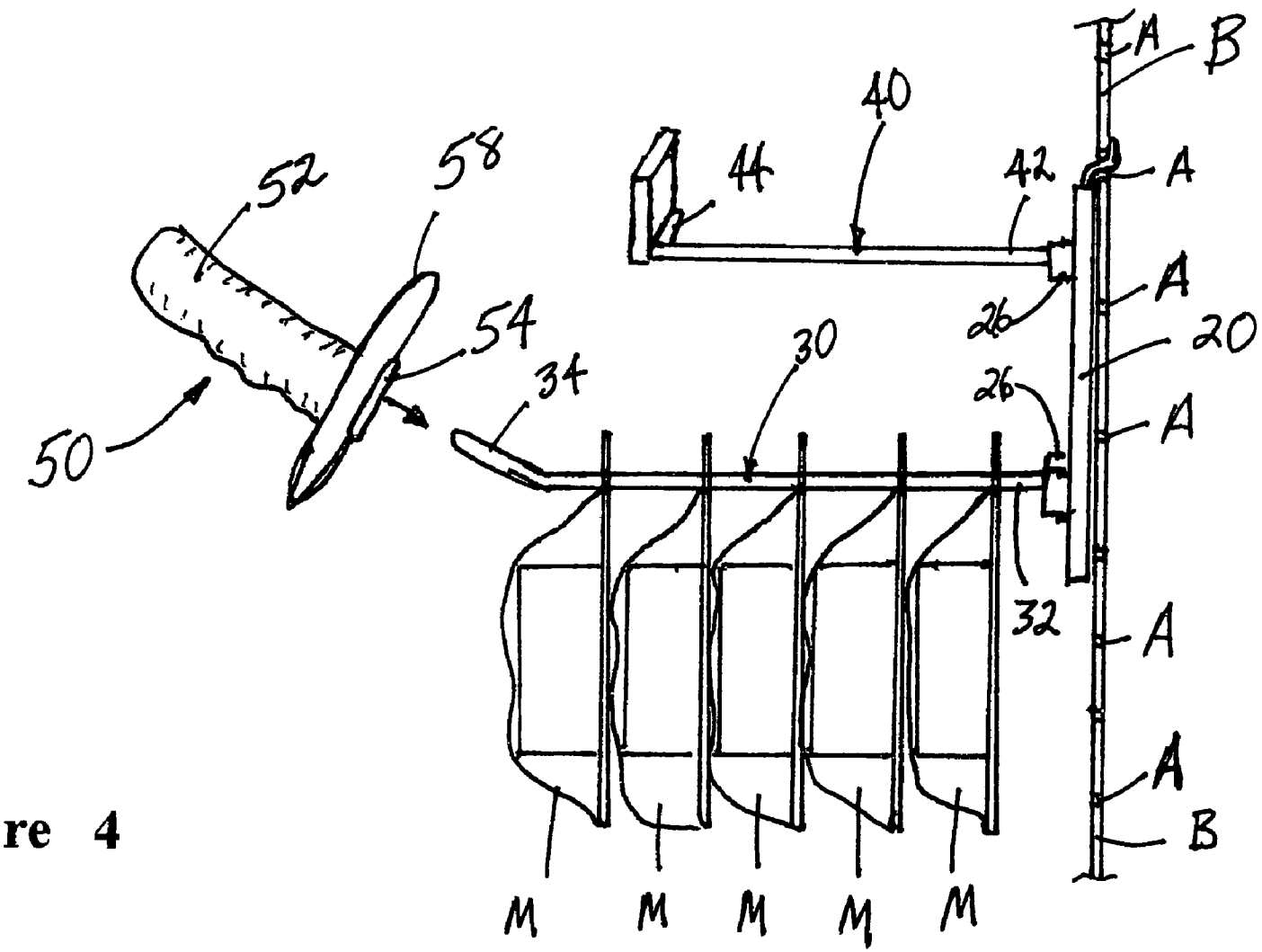
FIG. 4 is a side view of the displaying fixture assembly of the present invention attached to an upright support surface and holding a plurality of merchandise items.
Figure 5:
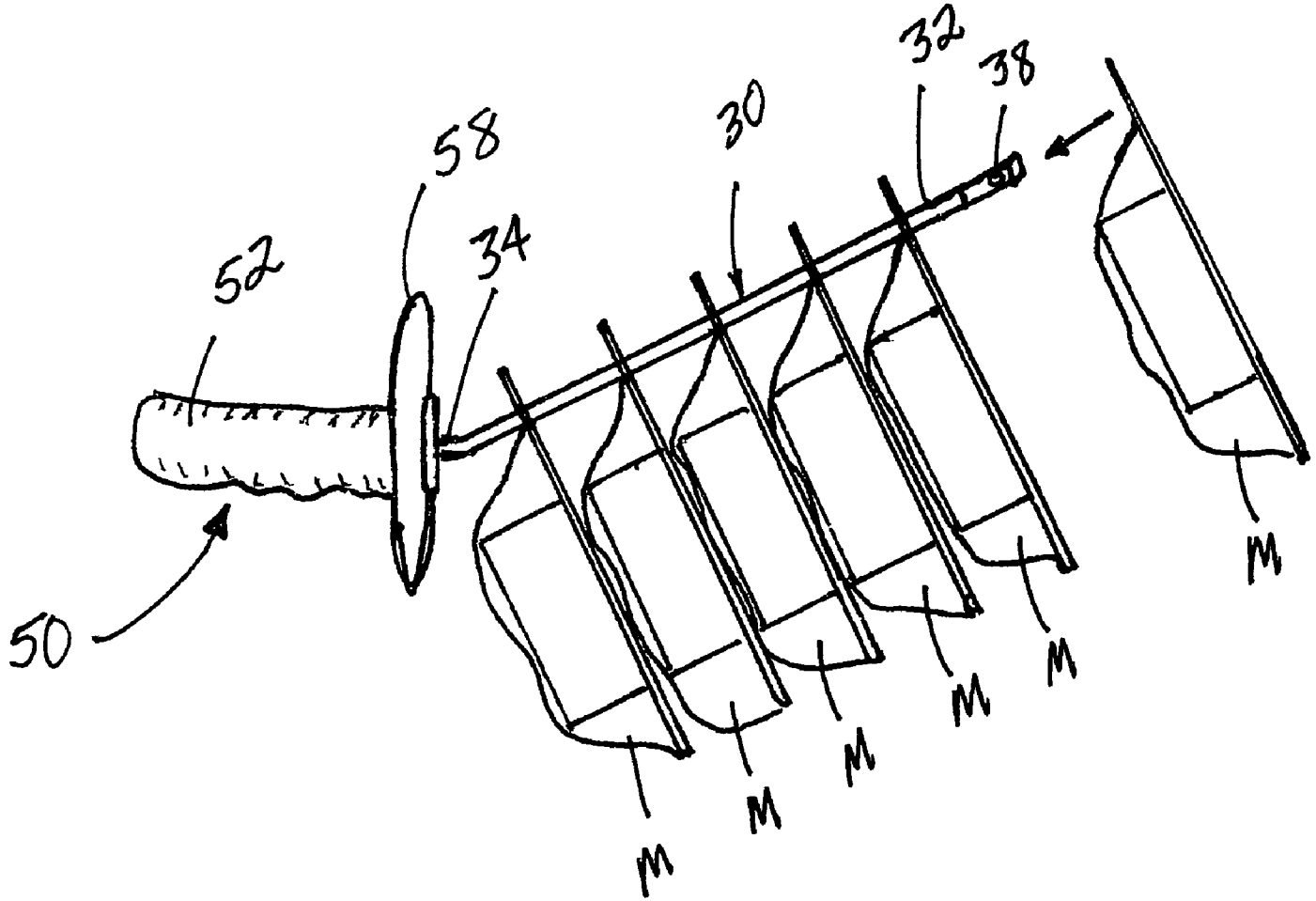
FIG. 5 is a side view of the handle member secured to the first bar member which is detached from the base member of the displaying fixture assembly of the present invention.

Referring now to FIGS. 1, 2 and 3, several views of the displaying fixture assembly 10 are shown. The assembly 10 includes a planar, base member 20 adapted for reversible attachment to an upright support surface S. The base member 20 includes a thicker section 26 having a first aperture 22 positioned opposite the upright support surface S. The aperture 22 is preferably non-circular in shape for reasons discussed below. The base member 20 also includes a plurality of attachment hooks 28 on one edge thereof for fastening the base member 20 to the upright support surface S. For example, the support surface S is a pegboard with a uniformly spaced pattern of apertures A there through. The attachment hooks 28 of the base member 20 are spaced to fit into adjacent pegboard apertures A and allow the base member 20 to hang flat against the upright pegboard.

The display assembly 10 also includes an elongated bar member 30 having a first end 32 and a second end 34 and a central portion 36 there between. The bar member's first end 32 is also non-circular and insertable into the base member's first aperture 22 for releasably securing the first bar member 30 to the base member 20. Preferably, the bar member's first end 22 includes a detent 38 that releasably secures the bar member's first end 22 within the base member's first aperture 22. The first bar member's second end 34 is angled relative to the central portion 36 thereof. Preferably, the second end 34 is angled between about 10 degrees and about 90 degrees relative to the central portion 36 thereof. Most preferably, the second end 34 is angled between about 10 degrees and about 30 degrees relative to the central portion 36. The non-circular first end 32 of the bar member 30 allows the angled second end 34 thereof to be positioned in an upward orientation to retain merchandise items M hanging thereon.

The displaying assembly fixture 10 also includes a handle member 50 which has a cylindrical body portion 52 with an aperture 56 at a first end 54 thereof. The aperture 56 is sized to releasably secure the first bar member's angled second end 34 therein. The handle member 50 also includes an enlarged flange section 58 adjacent the apertured first end 54 thereof. By inserting the first bar member's angled second end 34 into the aperture 56 of the handle member's first end 54, a user can remove the first bar member's first end 32 from the aperture 24 in the base member 20 and add additional merchandise items M to the first bar member 30 adjacent the first end 32 thereof. Replacing the first end 32 of the first bar member 30 into the first aperture 22 of the base member 20 and removing the handle member 50 from the second end 34 of the first bar member 30 maintains the merchandise items M in order on the central portion 36 of the first bar member 30.

In a further embodiment of the invention, the base member 20 of the display fixture assembly 10 includes a second aperture 24 opposite the upright support surface S. A second elongated bar member 40 has a first end 42 and a second end 44 with a central portion 46 there between. The second bar member's first end 42 is insertable into the base member's second aperture 24 for releasably securing the second bar member 40 to the base member 20. The second bar member's second end 44 also is angled relative to the central portion 46 thereof. Preferably both the base member's second aperture 24 and the second bar member's first end 42 are non-circular to maintain the second bar member's second end 44 in a selected orientation. The second bar member's second end 44 is also fitted with an information display device 65 to provide identification and pricing of the displayed merchandise items M. Most preferably, the second bar member 40 is positioned above the first bar member 30 when the base member 20 is secured to the upright support surface S.

While the invention has been particularly shown and described with reference to preferred embodiments thereof, it will be understood by those skilled in the art that various changes in form and details may be made therein without departing from the spirit and scope of the invention.

I claim:

1. A displaying fixture assembly adapted for mounting on an upright support surface and supporting a plurality of merchandise items thereon, the fixture assembly comprising:

a planar, base member adapted for reversible attachment to the upright support surface, the base member including an aperture opposite the upright support surface;

an elongated bar member having first and second ends and a central portion, the bar member's first end insertable into the base member's aperture for releasably securing the bar member to the base member, the bar member's second end angled relative to the central portion thereof; and a handle member having a cylindrical body portion with an aperture at a first end thereof, the aperture sized to releasably secure the bar member's angled second end therein, the handle member including an enlarged flange section adjacent the apertured first end thereof;

whereby inserting the bar member's angled second end into the handle member's apertured first end enables a user to remove the bar member's first end from the base member and add additional merchandise items to the bar member adjacent the first end thereof.

2. The displaying fixture assembly adapted for mounting on an upright support surface and supporting a plurality of merchandise items thereon of claim 1, wherein the base member includes at least two hook portions for securing the base member to the upright support surface.

3. The displaying fixture assembly adapted for mounting on an upright support surface and supporting a plurality of merchandise items thereon of claim 1, wherein the base member's aperture and the bar member's first end are non-circular.

4. The displaying fixture assembly adapted for mounting on an upright support surface and supporting a plurality of merchandise items thereon of claim 1, wherein the bar member's first end includes a detent for securing the first end within the base member's aperture.

5. The displaying fixture assembly adapted for mounting on an upright support surface and supporting a plurality of merchandise items thereon of claim 1, wherein the bar member's second end is angled between about 10 and 90 degrees relative to the bar member's central portion.

6. The displaying fixture assembly adapted for mounting on an upright support surface and supporting a plurality of merchandise items thereon of claim 1, wherein the handle member is fabricated from an elastomeric material providing a friction fit between the bar member' second end and the aperture in the handle member's aperture.

7. The displaying fixture assembly adapted for mounting on an upright support surface and supporting a plurality of merchandise items thereon of claim 1, further including a second aperture in the base member opposite the upright support surface and a second bar member removably attachable therein, the second bar member including a second end angled at 90 degrees relative to the second bar member's central portion.

8. The displaying fixture assembly adapted for mounting on an upright support surface and supporting a plurality of merchandise items thereon of claim 7, wherein the base member's second aperture and the second bar member's first end are non-circular.

9. The displaying fixture assembly adapted for mounting on an upright support surface and supporting a plurality of merchandise items thereon of claim 7, wherein the second bar member's first end includes a detent for securing the first end within the base member's second aperture.

10. A displaying fixture assembly adapted for mounting on an upright support surface and supporting a plurality of merchandise items thereon, the fixture assembly comprising;

a planar base member adapted for reversible attachment to the upright support surface, the base member including a non-circular aperture opposite the upright support surface;

an elongated bar member having first and second ends and a central portion, the bar member's first end being non-circular and insertable into the base member's aperture for releasably securing the bar member to the base member, the bar member's second end angled relative to the central portion thereof; and a handle member having a cylindrical body portion with an aperture at a first end thereof, the aperture sized to releasably secure the bar member's angled second end therein, the handle member including an enlarged flange section adjacent the apertured first end thereof;

whereby inserting the bar member's angled second end into the handle member's apertured first end enables a user to remove the bar member's first end from the base member and add additional merchandise items to the bar member adjacent the first end thereof.

11. The displaying fixture assembly adapted for mounting on an upright support surface and supporting a plurality of merchandise items thereon of claim 10, wherein the base member includes at least two hook portions for securing the base member to the upright support surface.

12. The displaying fixture assembly adapted for mounting on an upright support surface and supporting a plurality of merchandise items thereon of claim 10, wherein the bar member's first end includes a detent for securing the first end within the base member's aperture.

13. The displaying fixture assembly adapted for mounting on an upright support surface and supporting a plurality of merchandise items thereon of claim 10, wherein the bar member's second end is angled between about 10 and 90 degrees relative to the bar member's central portion.

14. The displaying fixture assembly adapted for mounting on an upright support surface and supporting a plurality of merchandise items thereon of claim 10, wherein the handle member is fabricated from an elastomeric material providing a friction fit between the bar member' second end and the aperture in the handle member's aperture.

15. The displaying fixture assembly adapted for mounting on an upright support surface and supporting a plurality of merchandise items thereon of claim 10, further including a second aperture in the base member opposite the upright support surface and a second bar member removably attachable therein, the second bar member including a second end angled at 90 degrees relative to the second bar member's central portion.

16. The displaying fixture assembly adapted for mounting on an upright support surface and supporting a plurality of merchandise items thereon of claim 15, wherein the base member's second aperture and the second bar member's first end are non-circular.

17. The displaying fixture assembly adapted for mounting on an upright support surface and supporting a plurality of merchandise items thereon of claim 15, wherein the second bar member's first end includes a detent for securing the first end within the base member's second aperture.

18. A displaying fixture assembly adapted for mounting on an upright support surface and supporting a plurality of merchandise items thereon, fixture assembly comprising;

a planar base member adapted for reversible attachment to the upright support surface, the base member including first and second non-circular apertures opposite the upright support surface;

a first elongated bar member having first and second ends and a central portion, the first bar member's first end being non-circular and insertable into the base member's first aperture for releasably securing the first bar member to the base member, the bar member's second end angled relative to the central portion thereof;

a second elongated bar member having first and second ends and a central portion, the second bar member's first end being non-circular and insertable into the base member's second aperture for releasably securing the second bar member to the base member, the second bar member's second end angled at 90 degrees relative to the second bar member's central portion; and a handle member having a cylindrical body portion with an aperture at a first end thereof, the aperture sized to releasably secure the first bar member's angled second end therein, the handle member including an enlarged flange section adjacent the apertured first end thereof;

whereby inserting the first bar member's angled second end into the handle member's apertured first end enables a user to remove the first bar member's first end from the base member and add additional merchandise items to the first bar member adjacent the first end thereof.

* * * * *